United States Patent [19]

Knapp et al.

[11] 4,341,192

[45] Jul. 27, 1982

[54] FUEL INJECTION SYSTEM

[75] Inventors: Heinrich Knapp, Leonberg; Wolfgang Maisch, Schwieberdingen; Klaus-Jürgen Peters, Affalterbach; Michael Wissmann, Gerlingen; Günther Jäggle; Peter Schelhas, both of Stuttgart, all of Fed. Rep. of Germany

[73] Assignee: Robert Bosch GmbH, Stuttgart, Fed. Rep. of Germany

[21] Appl. No.: 129,496

[22] Filed: Mar. 11, 1980

[30] Foreign Application Priority Data

May 8, 1979 [DE] Fed. Rep. of Germany ..... 2918479

[51] Int. Cl.[3] ..... F02M 69/00

[52] U.S. Cl. ..... 123/452

[58] Field of Search ..... 123/452

[56] References Cited

U.S. PATENT DOCUMENTS 4,015,571 4/1977 Stumpp ..... 123/452 X 4,064,854 12/1977 Fehrenbach et al. ..... 123/452

4,075,995 2/1978 Kramer ..... 123/452

*Primary Examiner*—Wendell E. Burns

*Attorney, Agent, or Firm*—Edwin E. Greigg

[57] ABSTRACT

A fuel injection system is proposed which brings about an improvement in the acceleration behavior of an internal combustion engine. The fuel injection system includes metering valves actuatable by means of an air flow measuring device, at which valves a pressure difference can be held constant via control valves and the pressure difference is variable in accordance with operational characteristics of the engine. To this end, the control valves are located on a control pressure line in which a control throttle and an electromagnetic valve are disposed. At the same time, pressure limitation elements communicate with the control pressure line and, in the event of acceleration of the engine, reduce the extent of increase of control pressure and thus assure fuel metering corresponding with the operational state of the engine.

4 Claims, 3 Drawing Figures

FUEL INJECTION SYSTEM

BACKGROUND OF THE INVENTION

The invention relates to a fuel injection system for an internal combustion engine which includes a measuring device for measuring air quantity supplied to the engine, a metering valve for metering fuel to be injected in proportion to the supplied air quantity and a control valve downstream of the metering valve for controlling the pressure difference at the metering valve, and thus the air/fuel ratio, as a function of selected engine operating parameters. The control valve is embodied as a differential pressure valve including a movable valve element having one side subjected to the fuel pressure downstream of the metering valve and an opposite side subjected to the pressure of a control pressure line. One end of the control pressure line is connected to a pressure source. The control pressure is relieved at an opposite end of the control pressure line by an electromagnetic valve which is actuated to vary the air/fuel ratio in accordance with the selected engine operating parameters.

However in known fuel injection systems of this type such as that described in U.S. Pat. No. 4,064,854, issued Dec. 27, 1977 to Fehrenbach et al; there is the disadvantage that in the event of acceleration, if the metering valves are suddenly opened, the fuel pressure in the chambers of the control valves downstream of the metering valves increases, because the pressure in the chambers of the control valves communicating with the control pressure line does not drop rapidly enough. The pressure increase at the metering valves causes too small a fuel quantity to be metered for that operational state of the engine.

SUMMARY OF THE INVENTION

In the invention described herein, a fuel injection system, of the known type described above, further comprises a pressure limitation element, such as a differential pressure valve or a hydraulic reservoir, which is disposed in the control pressure line upstream of the electromagnetic valve.

The fuel injection system according to the invention has the advantage over the prior art in that a reduction of the pressure differential at the metering valves during acceleration is avoided, so that a fuel quantity which corresponds to the operational state of the engine can be metered at the metering valves.

The invention will be better understood and further objects and advantages thereof become more apparent from the ensuing detailed description of preferred embodiments taken in conjunction with the drawings.

DESCRIPTION OF THE PREFERRED EMBODIMENTS

Figure 1:
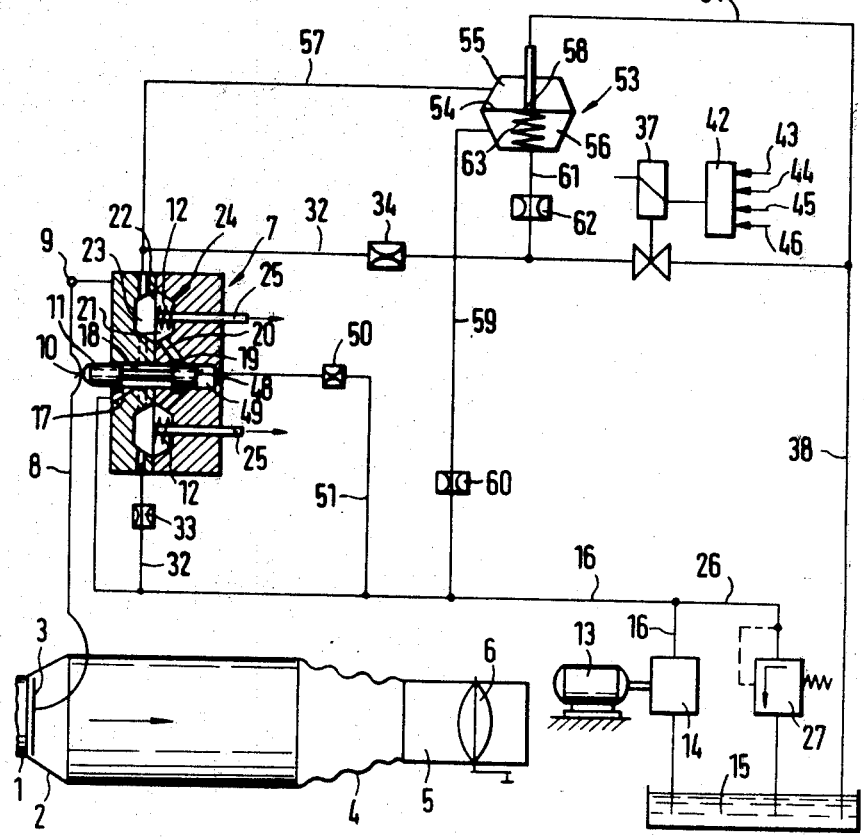
FIG. 1 shows schematically a first exemplary embodiment of a fuel injection system.

Turning now to the drawings of the fuel injection system shown in FIG. 1, the air required for combustion flows in the direction of the arrow into an intake manifold section 1, a conical section 2 having a measuring device 3 arranged therein and further through a connection conduit 4 and an intake manifold section 5 having an arbitrarily actuatable throttle valve 5 to one or more cylinders, not shown, of a mixture-compressing internal combustion engine with externally-supplied ignition. The measuring device 3 is a plate disposed transversely to the direction of air flow, which moves within the conical section 2 of the intake manifold, by way of example, in accordance with an approximately linear function of the quantity of air flowing through the intake manifold; at a constant restoring force which engages the measuring device 3 and a constant air pressure prevailing ahead of the measuring device 3, the pressure prevailing between the measuring device 3 and the throttle valve 6 likewise remains constant.

The measuring device 3 directly controls a metering and distribution valve 7. A lever 8 connected therewith serves to transmit the adjustment motion of the measuring device 3 onto the metering and distribution valve 7. The lever 8 is pivotable about a rotation point 9 attached to the housing and during its pivoting motion actuates with a nose 10 the movable valve element of the metering and distribution valve 7, which is embodied as a control slide 11.

The fuel, supplied for instance by a fuel pump 14 driven by means of an electromotor 13, flows out of a fuel container 15 and through a fuel supply line 16 and a channel 17 into an annular groove 18 of the control slide 11. Depending upon the position of the control slide 11, the annular groove 18 overlaps control slits 19, which lead through channels 20 to one chamber 21 for each slit, to a greater or lesser extent. The chamber 21 is separated by a diaphragm 22 from a control chamber 23, and the diaphragm 22 acts as the movable element of one control valve 24 per chamber 21. From the chambers 21, the fuel proceeds via injection channels to the individual injection valves, not shown, which discharge into the intake manifold in the region of the engine cylinders. The control valves 24 may be embodied as differential pressure valves having, by way of example, compression springs 12 disposed in the chambers 21, as shown; or, as not shown, they may be embodied as equal-pressure valves without compression springs.

A line 26, into which a pressure limitation valve 27 is inserted, branches off from the fuel supply line 16. Through this line 26, fuel can flow back into the fuel container 15.

A control pressure line 32 also branches off from the fuel supply line 16. Disposed in series in this control pressure line 32 are a control throttle 33, the control chambers 23 of the control valves 24, a partial throttle 34 and an electromagnetic valve 37, by way of which the fuel in the control pressure line 32 can flow back, pressure-free, through a return flow line 38 to the fuel container 15. The electromagnetic valve 37 is actuatable by means of a known electric control apparatus 42, into which operational characteristics of the engine, indicated by way of example by arrows, can be fed after being converted to electrical values. These characteristics may be the exhaust gas composition 43, ascertained by an oxygen sensor, for instance; the air temperature 44; a signal 45 which characterizes the acceleration mode; or the throttle valve position 46.

The control slide 11 protrudes with its end face 48 remote from the lever 8 into a pressure chamber 49, which communicates via a damping throttle 50 and a line 51 with the fuel supply line 16. The pressure of the fuel in the pressure chamber 49 on the end face 48 of the control slide generates the restoring force exerted upon the measuring device 3. Pulsations in the pressure chamber, caused by the pulsations in air flow which act upon the measuring device 3, are damped by means of the damping throttle 50.

The mode of operation of the fuel injection system described thus far is as follows:

When the engine is running, air is induced via the intake manifold 1, 4 and 5, which causes a certain amount of deflection of the measuring device 3 out of its position of rest. The control slide 11 of the metering and distribution valve 7 is also displaced in accordance with the amount of deflection of the measuring device 3; the control slide 11 thus being arranged to meter the quantity of fuel flowing to the injection valves.

In order to keep the fuel-air mixture at a richer or leaner level in accordance with the operational characteristics of the engine, a variation is necessary in the proportionality between the induced air quantity and the metered fuel quantity, depending on these operational characteristics. The variation of the fuel-air mixture may advantageously be effected by means of varying the differential pressure at the metering and distribution valve 17. In the present exemplary embodiment, the variation of the differential pressure occurs at the control slits 19 of the metering valves 18, 19 by means of the subdivision of the pressure at the control throttle 33 and the partial throttle 34, by means of the variable fuel quantity which flows through the electromagnetic valve 37. The fuel quantity flowing in the control pressure line 32 when the electromagnetic valve 37 is opened is determined only by the throttles 33 and 34 and by the throttling of the electromagnetic valve 37, so that the pressure difference at the control throttle 33 and thus the pressure difference at the control slits 19 of the metering valves 18, 19 as well is at a maximum.

Thus, when the electromagnetic valve 37 is opened, the highest enrichment rate results—that is, the richest fuel-air mixture, because when the induced air quantity remains the same, the maximum pressure difference at the control slits 19 of the metering valves 18, 19 produces the maximum metered fuel quantity. The electromagnetic valve 37 is advantageously actuated in a so-called cyclic fashion; that is, the ratio of the length of the opened time of the electromagnetic valve 37 to the closed time is varied.

Now, if the engine is abruptly accelerated—that is, the throttle valve 6 is abruptly opened—then an increased adjusting force results at the measuring device 3, and the control slide 11 is displaced in the direction of an increased amount of overlap of the annular groove 18 with the control slits 19.

The increased fuel quantity which is now metered at the control slits 19 causes a pressure increase in the chambers 21 of the control valves 24, because the pressure increased in the control chambers 23 of the control valves 24 which occurs simultaneously cannot be reduced rapidly enough; instead, the diaphragms 22 are prevented from effecting a more extensive opening of the injection valves 25. The pressure increase in the chambers 21 of the pressure control valves 24, however, causes the pressure difference at the control slits 19 and the metered fuel quantity to drop, and thus the engine cannot be supplied with the fuel quantity necessary during acceleration. In order to prevent this situation, it is necessary to limit the pressure in the control pressure line 32 and thus in the control chambers 23 of the control valves 24. Thus, in the exemplary embodiment of FIG. 1, a limitation element in the form of a differential pressure valve 53 is provided, said differential pressure valve having a diaphragm 54 embodied as its movable element which separates a first chamber 55 from a second chamber 56. The first chamber 55 of the differential pressure valve 53 communicates via a line 57 with the control pressure line 32 upstream of the partial throttle 34 and has a fixed valve seat 58 which cooperates with the diaphragm 54. The second chamber 56 of the differential pressure valve 53 communicates on one side via a line 59 and a first throttle 60 with the fuel supply line 16 and further, via a further line 61 and a second throttle 62, with the control pressure line 32 between the partial throttle 34 and the electromagnetic valve 37. The first throttle 60 is intended to have the same throttle cross section as the control throttle 33, and the second throttle 62 should have the same throttle cross section as the partial throttle 34. A spring 63 which urges the diaphragm 54 in the closing direction of the differential pressure valve 53 is provided in the second chamber 56. This described arrangement makes it possible in the case of an abrupt elevation of pressure in the control chambers 23 of the control valves 24 during acceleration for the differential pressure valve 43 to open in accordance with the force of the spring 63, and then a rapid drop in pressure can take place in the control pressure line 32 by means of the discharge of fuel via the fixed valve seat 58 into a line 64 which communicates with the return flow line 38. Thus a reduction in the pressure difference at the control slits 19 and an according reduction in the metered fuel quantity in the event of acceleration is prevented.

Figure 2:
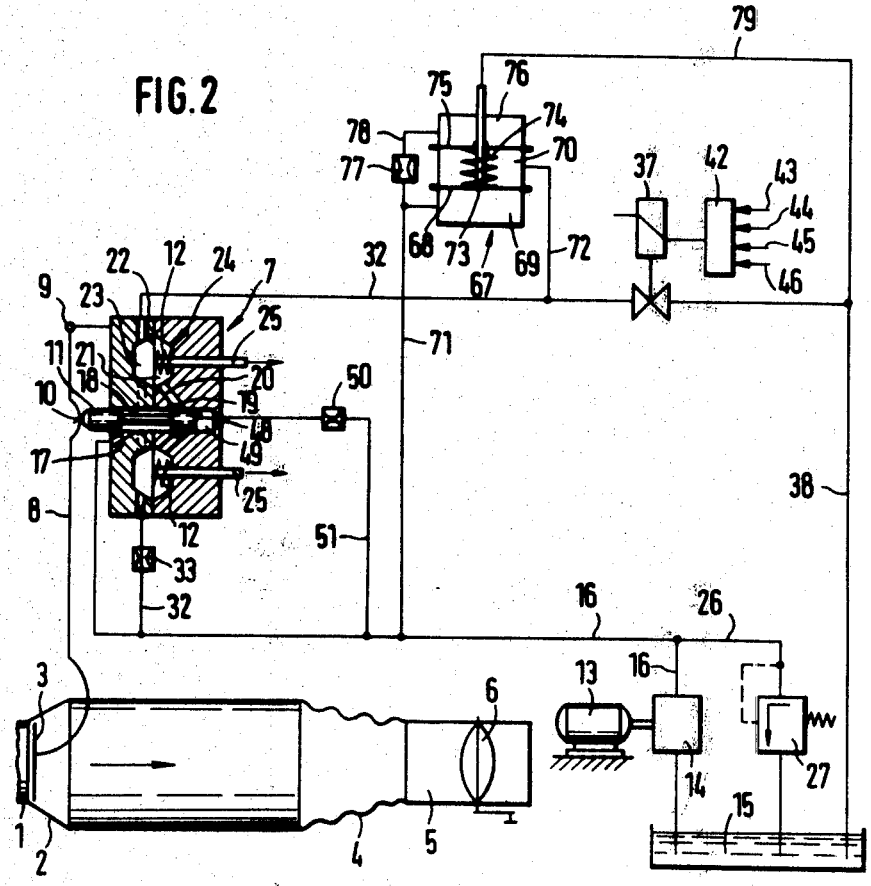
FIG. 2 shows a still further schematic view of a second exemplary embodiment of a fuel injection system.

In the second exemplary embodiment of the invention shown in FIG. 2, elements which correspond to those of FIG. 1 are given identical reference numerals. Provided as a pressure limitation element for the pressure in the control pressure line 32 in the second exemplary embodiment of FIG. 2 is a differential pressure valve 67, which has a diaphragm 68 which separates a first chamber 69 from a second chamber 70. The first chamber communicates via a line 71 with the fuel supply line 16, and the second chamber 70 communicates via a line 72 with the control pressure line 32 upstream of the electromagnetic valve 37. A fixed valve seat 73 is provided in the chamber 70 which cooperates with the diaphragm 68. The diaphragm 68 is urged in the opening direction of the differential pressure valve by a spring 74, which is supported on the other end on a diaphragm 75 that is embodied as a yielding wall. The diaphragm 75 is slidably supported on the fixed valve seat 73 and separates the second chamber 70 from a third chamber 76, which communicates via an uncoupling throttle 77 and a line 78 with the line 71 and thus with the fuel supply line 16. Fuel flowing out via the fixed valve seat 73 can proceed via a line 79 into the return flow line 38. The occurrence of acceleration now has the effect that, because of the pressure increase in the chambers 21 of the control valves 24 and the systematic pressure reduction in the fuel supply line 16, the pressure in the second chamber 70 of the differential pressure valve 67 is increased, and the pressure in the first chamber 69 is reduced, so that the differential pressure valve 67 opens and fuel can flow out of the control pressure line 32 via the fixed valve seat 73. As a result, the pressure in the control pressure line 32 drops and thus also drops in the control chambers 23 as well.

which causes the diaphragms 22 of the control valves 24 to open the control valves 24 to a greater extent, and the required pressure difference at the control slits 19 needed for metering is accordingly established.

Figure 3:
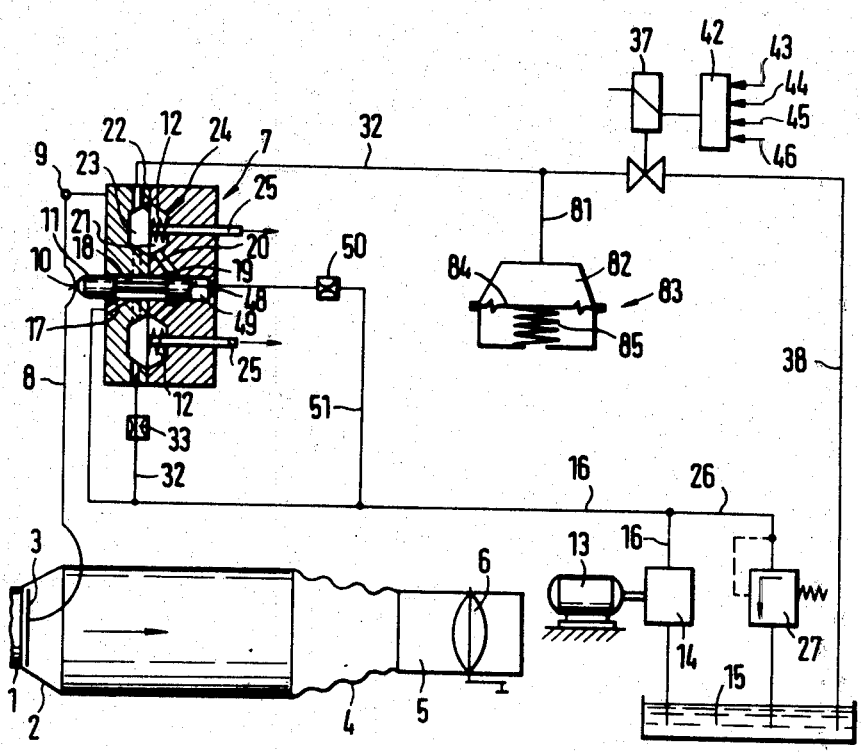
FIG. 3 shows still another schematic view of a third exemplary embodiment of a fuel injection system.

In the third exemplary embodiment of the invention shown in FIG. 3, in which elements that remain the same as in previous embodiments are again given identical reference numerals, a reservoir chamber 82 of a hydraulic reservoir 83 which acts as the pressure limitation element, and has a reservoir diaphragm 84 supported on a reservoir spring 85, communicates via a line 81 with the control pressure line 32 upstream of the electromagnetic valve 37. As a result of disposing the hydraulic reservoir 83 in the control pressure line 32, a pressure increase in the control chambers 23 of the control valves 24 in the event of acceleration of the engine is damped, so that the extent of decrease in the pressure differential at the control slits 19 of the metering valves is reduced.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. In a fuel injection system for an internal combustion engine, including an intake manifold, through which air is supplied to the engine, a measuring device which is disposed within the intake manifold and which is displaceable therein against a restoring force in accordance with the air quantity flowing through the intake manifold, an arbitrarily actuatable throttle valve which is disposed in series with the measuring device within the intake manifold, a fuel supply line, a fuel metering valve, which is disposed in the fuel supply line and which includes a movable element whose position is determined by the measuring device, for metering a fuel quantity to be injected corresponding to the air quantity flowing through the intake manifold, a control pressure line, having opposite ends, a control throttle, disposed between one end of the control pressure line and a portion of the fuel supply line upstream of the metering valve, through which the control pressure line communicates with the fuel supply line, an electromagnetic valve, which is disposed at the other end of the control pressure line, for relieving the pressure in the control pressure line, valve actuating means for actuating the electromagnetic valve in accordance with selected operational characteristics of the engine, pressure control means for controlling the pressure in the fuel supply line upstream of the metering valve, and a control valve for controlling the pressure differential at the metering valve, the control valve including a movable valve element having one side subjected to the fuel pressure downstream of the metering valve and an opposite side subjected to the pressure of the control pressure line, the improvement which comprises:

a pressure limitation element which is disposed upstream of the electromagnetic valve in the control pressure line.

2. A fuel injection system, as described in claim 1, which further comprises:

a partial throttle disposed in the control pressure line between the control valve and the electromagnetic valve;

a first throttle having a throttle cross section which is identical to the throttle cross section of the control throttle;

a second throttle having a throttle cross section which is identical to the throttle cross section of the partial throttle; and said pressure limitation element, which is embodied as a differential pressure valve comprising a housing, a movable valve element which is disposed within the housing, a first chamber and a second chamber which are defined by the housing and the movable valve element and which are separated by the movable valve element, a fixed valve seat disposed in the second chamber, and a spring, disposed in the first chamber, for urging the movable valve element in a closing direction, wherein the first chamber is arranged to communicate with the control pressure line upstream of the partial throttle, and wherein the second chamber is arranged to communicate with the fuel supply line upstream of the metering valve via the first throttle, and is further arranged to communicate with the fuel supply line between the partial throttle and the electromagnetic valve.

3. A fuel injection system, as described in claim 1, which further comprises an uncoupling throttle and wherein the pressure limitation element is embodied as a differential pressure valve which comprises:

a housing a movable valve element disposed within the housing;

a yielding wall disposed within the housing;

a first chamber defined by the movable valve element and the housing;

a second chamber defined by the movable valve element, the housing, and the yielding wall, wherein the movable valve element separates the first and second chambers;

a third chamber defined by the yielding wall and the housing, the yielding wall separating the third chamber from the second chamber;

a fixed valve seat disposed within the second chamber;

a spring, supported on the yielding wall within the second chamber, for urging the movable valve element in an opening direction;

the first chamber being arranged to communicate with the fuel supply line upstream of the metering valve;

the second chamber being arranged to communicate with the control pressure line upstream of the electromagnetic valve; and the third chamber being arranged to communicate with the fuel supply line upstream of the metering valve via the uncoupling throttle.

4. A fuel injection system, as described in claim 1, wherein the pressure limitation element is embodied as a hydraulic reservoir having a reservoir chamber which is arranged to communicate with the control pressure line upstream of the electromagnetic valve.

* * * * *